US009755336B2

(12) United States Patent
Cheng et al.

(10) Patent No.: US 9,755,336 B2
(45) Date of Patent: Sep. 5, 2017

(54) ELECTRICAL CONNECTOR AND METHOD OF MANUFACTURING THE SAME

(71) Applicant: FOXCONN INTERCONNECT TECHNOLOGY LIMITED, Grand Cayman (KY)

(72) Inventors: Chih-Pi Cheng, New Taipei (TW); Ming-Lun Szu, New Taipei (TW); Chao-Chieh Chen, New Taipei (TW); Wen He, Kunshan (CN); Quan Wang, Kunshan (CN); Yue Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/350,128

(22) Filed: Nov. 14, 2016

(65) Prior Publication Data

US 2017/0141495 A1 May 18, 2017

(30) Foreign Application Priority Data

Nov. 13, 2015 (CN) ..... 2015 1 0773754

(51) Int. Cl.
*H01R 24/00* (2011.01)
*H01R 12/71* (2011.01)
(Continued)

(52) U.S. Cl.
CPC ..... *H01R 12/712* (2013.01); *H01R 13/405* (2013.01); *H01R 13/6273* (2013.01);
(Continued)

(58) Field of Classification Search
CPC .... H01R 2107/00; H01R 43/24; H01R 43/16; H01R 24/60; H01R 13/6273; H01R 13/405; H01R 12/712
(Continued)

(56) References Cited

U.S. PATENT DOCUMENTS 7,572,146 B1 * 8/2009 Chiang ..... H01R 12/712 439/607.01
9,281,626 B2 * 3/2016 Lin ..... H01R 13/6581
(Continued)

*Primary Examiner* — Abdullah Riyami
*Assistant Examiner* — Nelson R Burgos-Guntin
(74) *Attorney, Agent, or Firm* — Wei Te Chung; Ming Chieh Chang

(57) ABSTRACT

An electrical connector comprising a first terminal assembly and a second terminal assembly which are formed on a same metal material. The first and the second terminal assemblies respectively comprise a plurality of first and second conductive terminals. The plurality of first and second conductive terminals respectively connect with each other by a first contact carrier and a second contact carrier which are connected by a third contact carrier formed on the metal material. Bending the third contact carrier at 180 degrees such that the first and the second terminal assemblies are arranged in parallel and up-and-down to each other. Providing an insulating material injecting molding on the first and the second terminal assemblies to form an insulating housing. Cutting and dislodging the first, the second and the third contact carriers to forming the electrical connector. The electrical connector is simple in manufacture and low in production cost.

20 Claims, 16 Drawing Sheets

(51) Int. Cl.

| | |
|---|---|
| ***H01R 24/60*** | (2011.01) |
| ***H01R 13/405*** | (2006.01) |
| ***H01R 13/627*** | (2006.01) |
| ***H01R 43/16*** | (2006.01) |
| ***H01R 43/24*** | (2006.01) |
| *H01R 107/00* | (2006.01) |

(52) U.S. Cl.
CPC ..... *H01R 24/60* (2013.01); *H01R 43/16* (2013.01); *H01R 43/24* (2013.01); *H01R 2107/00* (2013.01)

(58) Field of Classification Search
USPC ..... 439/83, 660, 885, 108
See application file for complete search history.

(56) References Cited

U.S. PATENT DOCUMENTS

2009/0047839 A1* 2/2009 Wu ..... H01R 27/00 439/660
2015/0333451 A1* 11/2015 Kao ..... H01R 24/60 439/607.01
2015/0340798 A1* 11/2015 Kao ..... H01R 13/6594 439/660
2016/0149348 A1* 5/2016 Kao ..... H01R 13/6585 439/607.05
2016/0156144 A1* 6/2016 Kao ..... H01R 24/60 439/676
2016/0181744 A1* 6/2016 Kao ..... H01R 24/60 439/676

* cited by examiner

ELECTRICAL CONNECTOR AND METHOD OF MANUFACTURING THE SAME

BACKGROUND OF THE INVENTION

1. Field of the Invention

The present invention relates generally to an electrical connector and method of manufacturing the same, more particularly to a low-cost receptacle connector.

2. Description of Related Arts

USB Implementers Forum issues a new specification which establishes a new type connector named as USB Type-C Cable and Connector, on Aug. 11, 2014. In the specification, the Type-C plug enhances ease of use by being plug-able in either upside-up or upside-down directions. The receptacle connector has more elements and has smaller, thinner size. Because of the number of terminals of the USB Type-C connector is large, the manufacturing process thereof is complicated and the cost is high.

Hence, a new and simple electrical connector and method of manufacturing the same is desired to improve those disclosed in the aforementioned proposal.

SUMMARY OF THE INVENTION

Accordingly, the object of the present invention is to provide a electrical connector which is simple in manufacture and low in production cost.

To fulfill the above-mentioned object, an electrical connector of a semi-finished product in the manufacturing process comprises a first terminal assembly and a second terminal assembly respectively comprising a plurality of first conductive terminals and second conductive terminals and an insulative housing being formed on the first terminal assembly and the second terminal assembly by the method of injection molding. The first terminal assembly and the second terminal assembly are arranged in a parallel manner and are spaced apart from each other. The plurality of first conductive terminals connect with each other by a first contact carrier. The plurality of second conductive terminals connect with each other by a second contact carrier. A third contact carrier is integrally connected between the first contact carrier and the second contact carrier. One of the first contact carrier, second contact carrier and third contact carrier is connected with a fourth contact carrier. The fourth contact carrier comprises a plurality of locating holes. The third contact carrier and the fourth contact carrier are located at outside of the insulating housing.

According to the present invention, the electrical connector of the invention is simple in process, so that it can effectively reduce the manufacturing cost.

DETAILED DESCRIPTION OF THE PREFERRED EMBODIMENT

Figure 1:
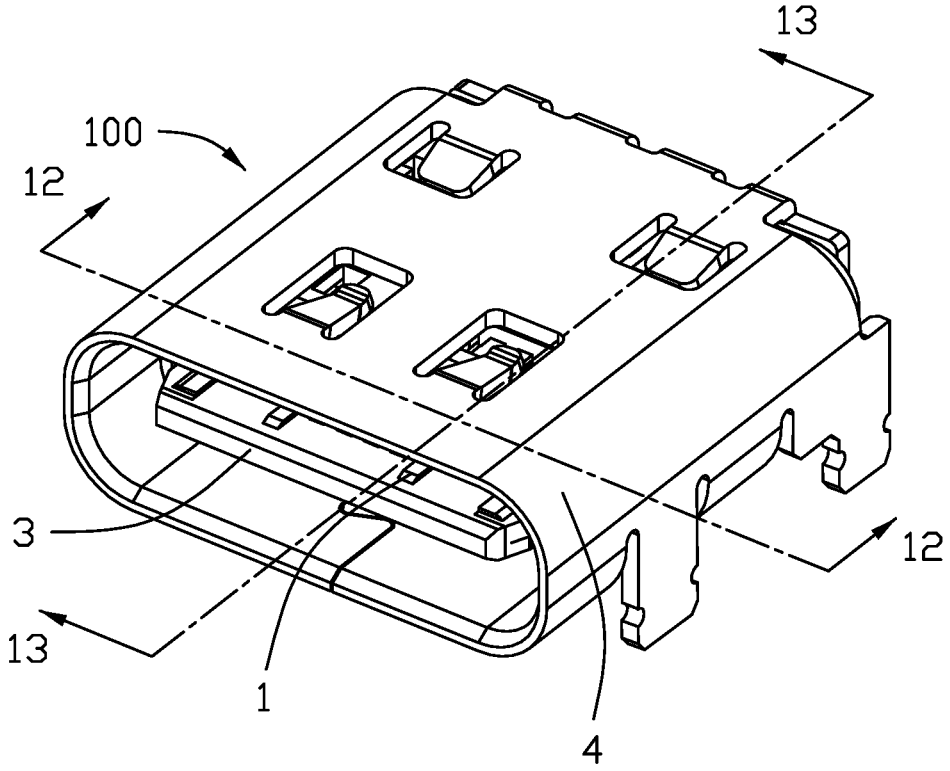
FIG. 1 is a top perspective view of an electrical connector made in accordance with the present invention.
Figure 2:
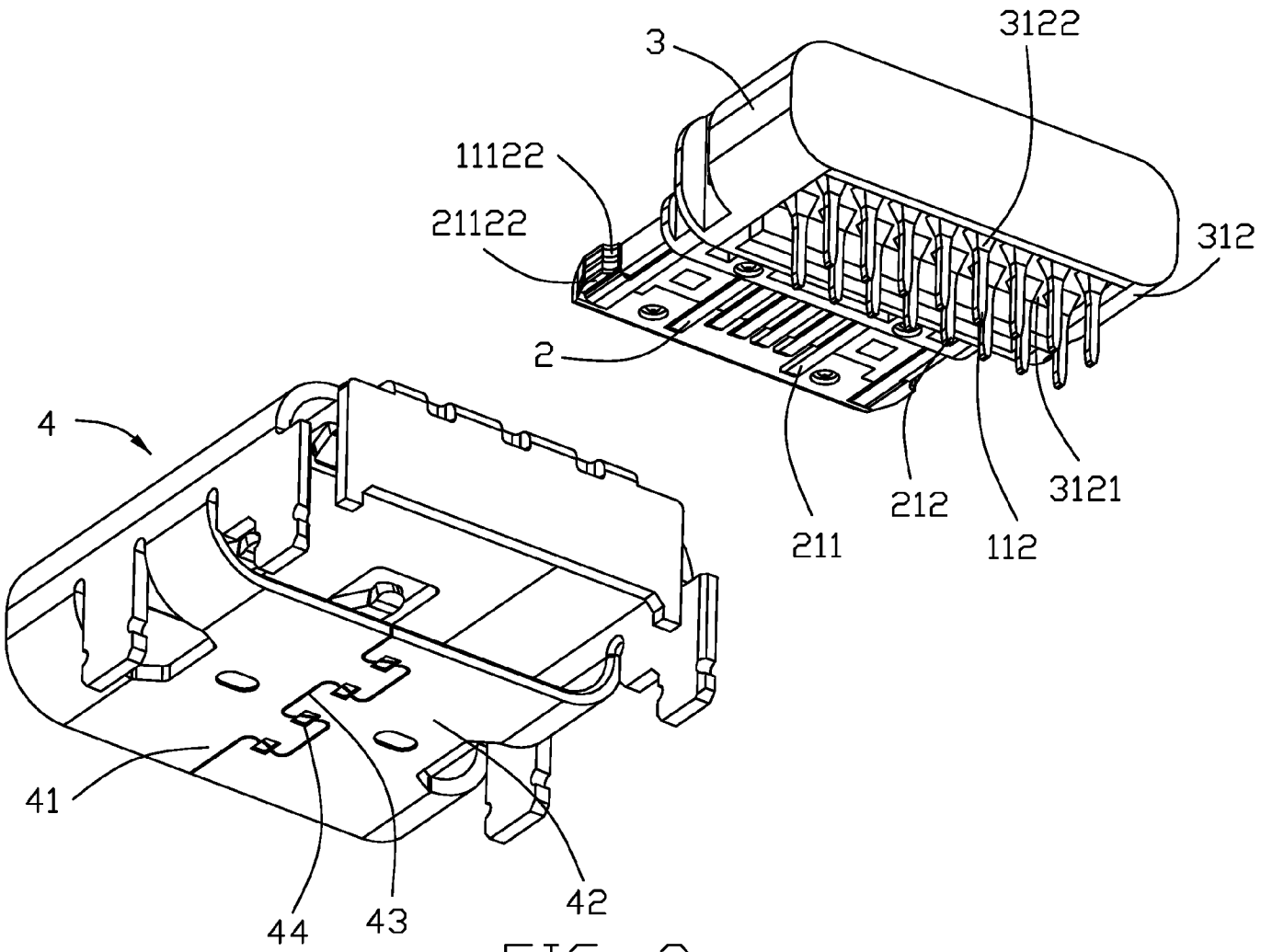
FIG. 2 is a bottom exploded perspective view of the electrical connector shown in FIG. 1.

Reference will now be made in detail to the preferred embodiment of the present invention.

Referring to FIGS. 1-15, an electrical connector 100 is a USB Type C receptacle connector mounted on a printed circuit board (PCB, not shown). Absolutely, it is not limited to a receptacle connector, but may also be a plug connector (not shown). The electrical connector 100 comprises a first terminal assembly 1 and a second terminal assembly 2 arranged in two rows in a vertical direction and an insulative housing 3 formed on the first terminal assembly 1 and the second terminal assembly 2 by the method of injection molding and a metallic shell 4 enclosing the insulative housing 3.

The arrangement of the first terminal assembly 1 and the second terminal assembly 2 are in accordance with USB 2.0 Type C transmission. The first terminal assembly 1 comprising a plurality of first conductive terminals 11. The second terminal assembly 2 comprising a plurality of second conductive terminals 21. The insulative housing 3 formed on the first terminal assembly 1 and the second terminal assembly 2 by the method of secondary injection molding comprises a base member 31 and a mating tongue 32 extending forwardly from the base member 31 in a mating direction. The insulating housing 3 comprises a first insulating body 33 which injecting molding on the first terminal assembly 1 and the second terminal assembly 2 firstly and a second insulating body 34 having better wear resistance than the first insulating body 33 which injecting molding on the first terminal assembly 1 and the second terminal assembly 2 secondly. The first insulating body 33 defined a first fixing hole 331 passing through the upper surface and the lower surface of the first insulating body 33. The number of the first fixing hole 331 can be set as appropriate. The front surface of the first insulating body 33 penetrates through a second fixing hole 332 connected with the first fixing hole 331. The insulating material forming the second insulating body 34 enters the first hole 331 and second fixing hole 332 respectively to form the first fixing block 341 and the second fixing block 342 connected with the first fixing block 341. As a result, the bonding reliability of the first insulating body 33 and the second insulating body 34 is effectively enhanced. The second insulating body 34 is at least coated on the front end surface of the mating tongue 32. The second insulating body 34 may also directly form the mating tongue 32. In the preferred embodiment of the present invention; the second insulating body 34 is at least coated on the front end surface of the mating tongue 32. That is not only wearproof but also effective in reducing cost. The first conductive terminal 11 comprises a first contact portion 111 and a first tail portion 112. The second conductive terminal 21 comprises a second contact portion 211 and a second tail portion 212. The first tail portion 112 and the second tail portion 212 are respectively bent perpendicularly to the first contact portion 111 and the second contact portion 211. The first tail portion 112 and the second tail portion 212 are soldered to the circuit board (not shown). The mating tongue 32 has an upper surface 321, a lower surface 322 opposed to the upper surface 321 and two side edges 323. The first contact portion 111 and the second contact portion 211 are respectively exposed to the upper surface 321 and the lower surface 322 of the mating tongue 32. The base member 31 has an upper surface 311 and a lower surface 312 opposite to the upper surface 311. The lower surface 312 is provided with a concave part 3121. The first tail portion 112 and the second tail portion 212 extend through the lower surface 312 of the base member 31. The base member 31 is provided with a fixing portion 3122 located in the concave part 3121. The fixing portion 3122 is generally tapered. The fixing portion 3122 can not only ensure the stability of the first tail portion 112 and the second tail portion 212, but also can effectively reduce the consumable of the base member 31.

Figure 12:
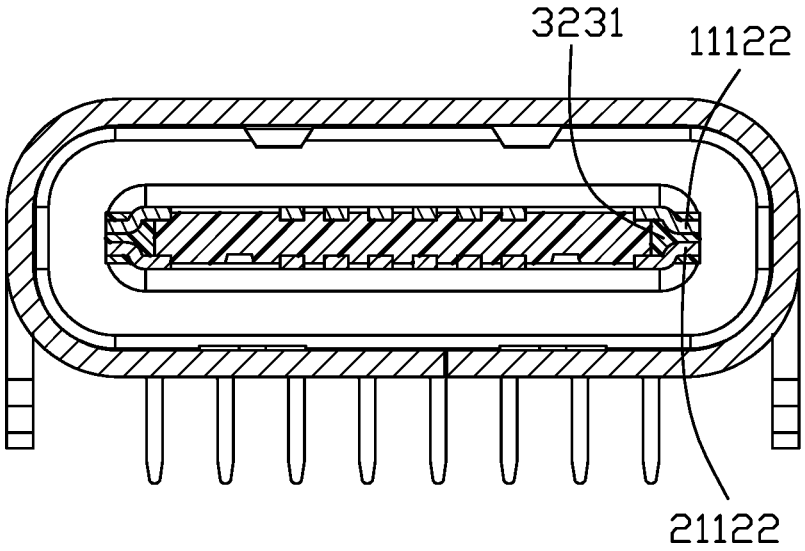
FIG. 12 is a cross-sectional view of the electrical connector of FIG. 1 along line 12-12 extending along a transverse direction.
Figure 13:
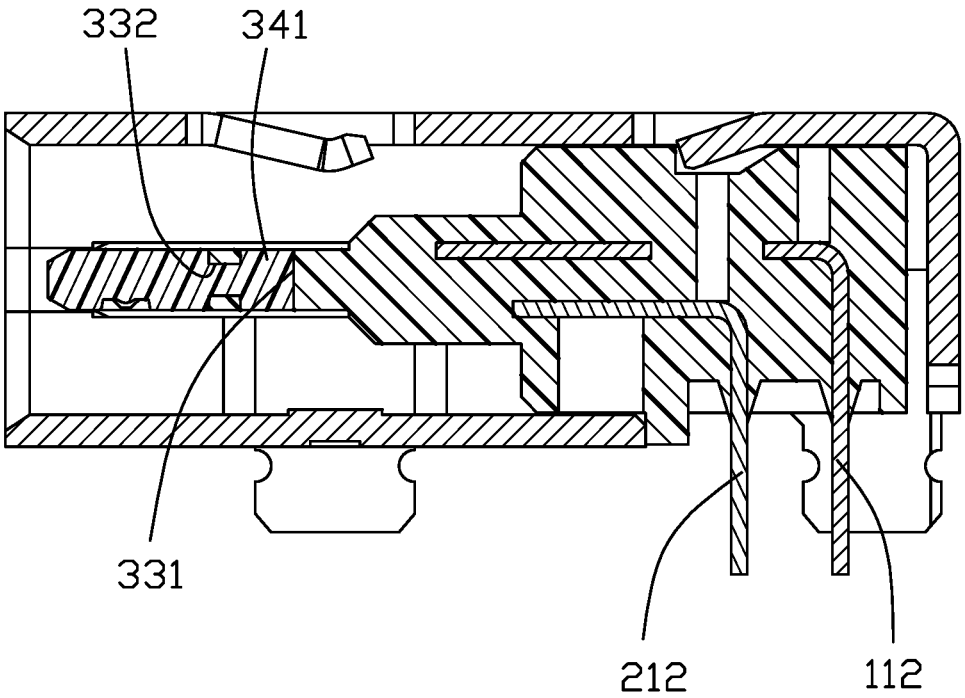
FIG. 13 is a cross-sectional view of the electrical connector of FIG. 1 along line 13-13 extending along a front-to-back direction.
Figure 14:
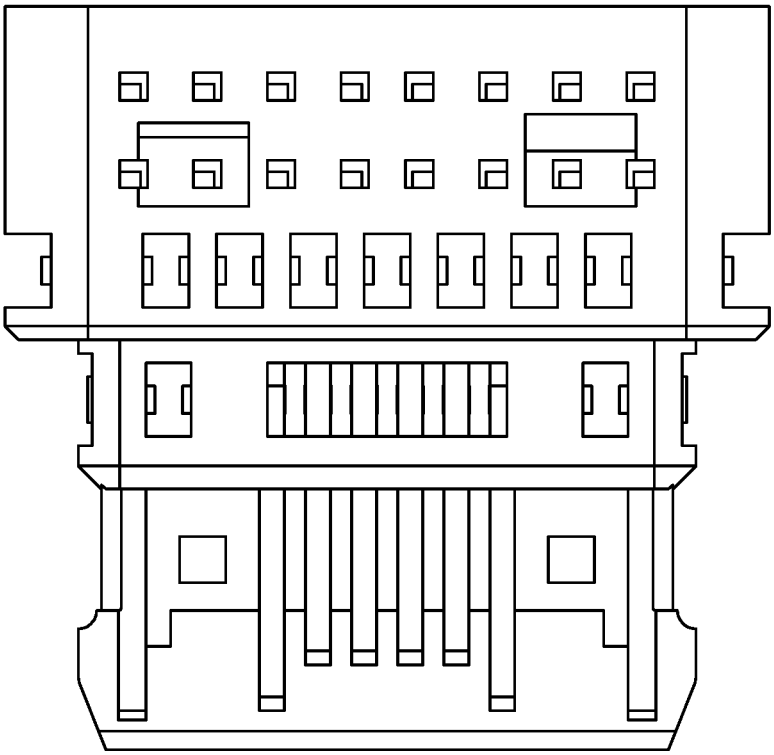
FIG. 14 is a top view of the electrical connector of FIG. 1 without the metal shell.
Figure 15:
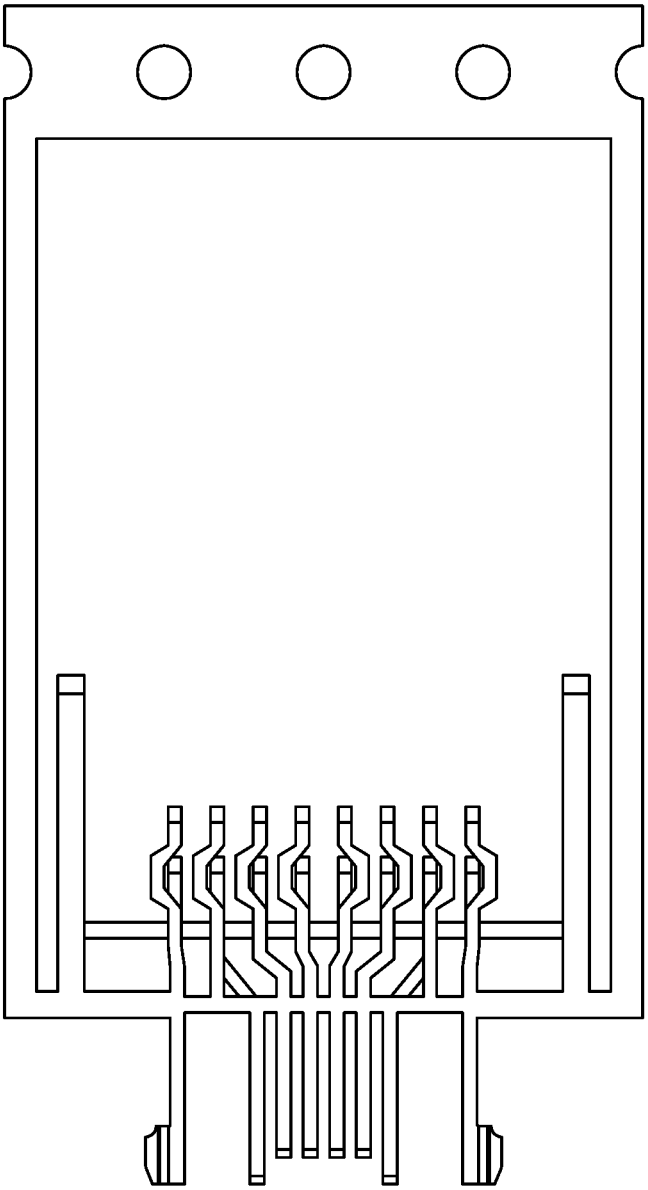
FIG. 15 is a top view of the metal material of FIG. 9.
Figure 16:
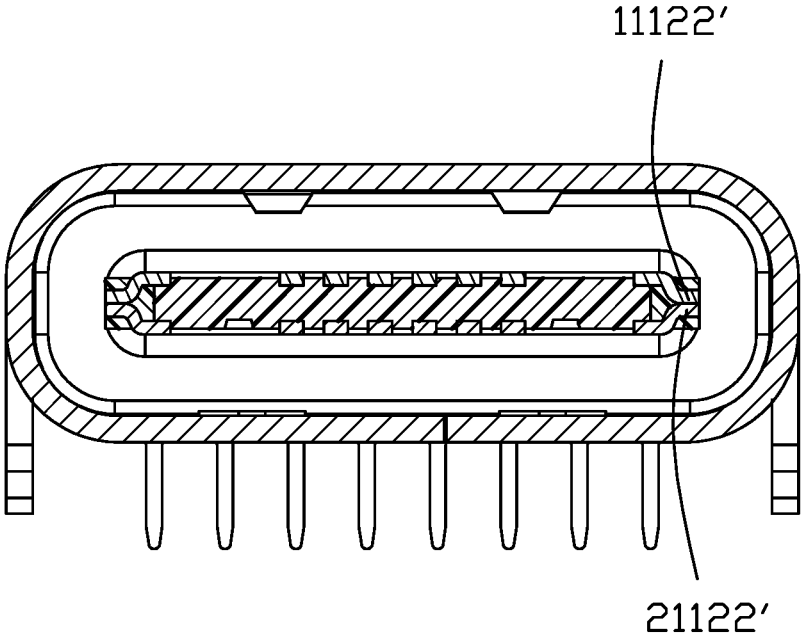
FIG. 16 is a cross-sectional view of the electrical connector according to another embodiment.

The two of the outermost first contact portions 111 of the first terminal assembly 1 are first grounding contact portions 111G. The two of the outermost second contact portions 211 of the second terminal assembly 2 are second grounding contact portions 211G. The first grounding contact portion 111G and the second grounding contact portion 211G are vertically aligned. The first grounding contact portion 111G and the second grounding contact portion 211G have reinforcing pieces 1112, 2112 extending from respective outer side edges thereof. The reinforcing pieces 1112, 2112 are substantially L-shaped. The reinforcing pieces 1112, 2112 comprise bent portions 11121, 21121 which are bent toward each other from the outer sides of the first grounding contact portion 111G and the second grounding contact portion 211G. The bent portions 11121, 21121 are buried in the insulative housing 3. The reinforcing piece 1112, 2112 is first bent toward the middle of the mating tongue 32 in a height direction and then bent outwardly in a transverse direction perpendicular to the height direction to form a locking side edge 11122, 21122. The reinforcing pieces 1112, 2112 form the locking side edges 11122, 21122 which projects outwardly to be exposed to both side edges of the mating tongue 32. The locking side edges 11122, 21122 are electrically connected to a pair of elastic member (not shown) disposed on both sides of a plug connector (not shown) for grounding. Compared to the traditional USB 2.0 Type-C connector, it is possible to be reliably grounding without providing an additional grounding/shielding plate (not shown) located between the first terminals 11 and the second terminals 21 in the vertical direction. Two side edges of the mating tongue 32 are respectively provided with protruding portions 3231. Each protruding portion 3231 comprises a stopper portion 3232 located behind the mating tongue 32. The locking side edges 11122, 21122 is exposed to outside of the stopper portion 3231. The protruding portion 3231 can effectively fix the locking side edges 11122, 21122. At the same time, the protruding portion 3231 may increase the contact strength between the locking side edges 11122, 21122 and elastic latching members (not shown) disposed on the plug connector (not shown). Notably, FIG. 12 shows the locking side edges 11122 and 21122 are spaced from each other via the protruding portion 3231 while FIG. 16 shows another embodiment in which the locking side edges 11122' and 21122' directly contact with each other in the vertical direction so as to enhance the grounding effect of the whole connector.

The metal shell 4 includes a first engaging edge 41 and a second engaging edge 42 opposing the first engaging edge 41. The first engaging edge 41 and the second joining side 42 include dovetailing portions 43 fitting to each other. Further, the dovetailing portions 43 are further provided with recesses 44 at the mating portion. The recesses 44 can effectively strengthen the bonding force between the first engaging edge 41 and the second engagement edge 42.

Figure 3:
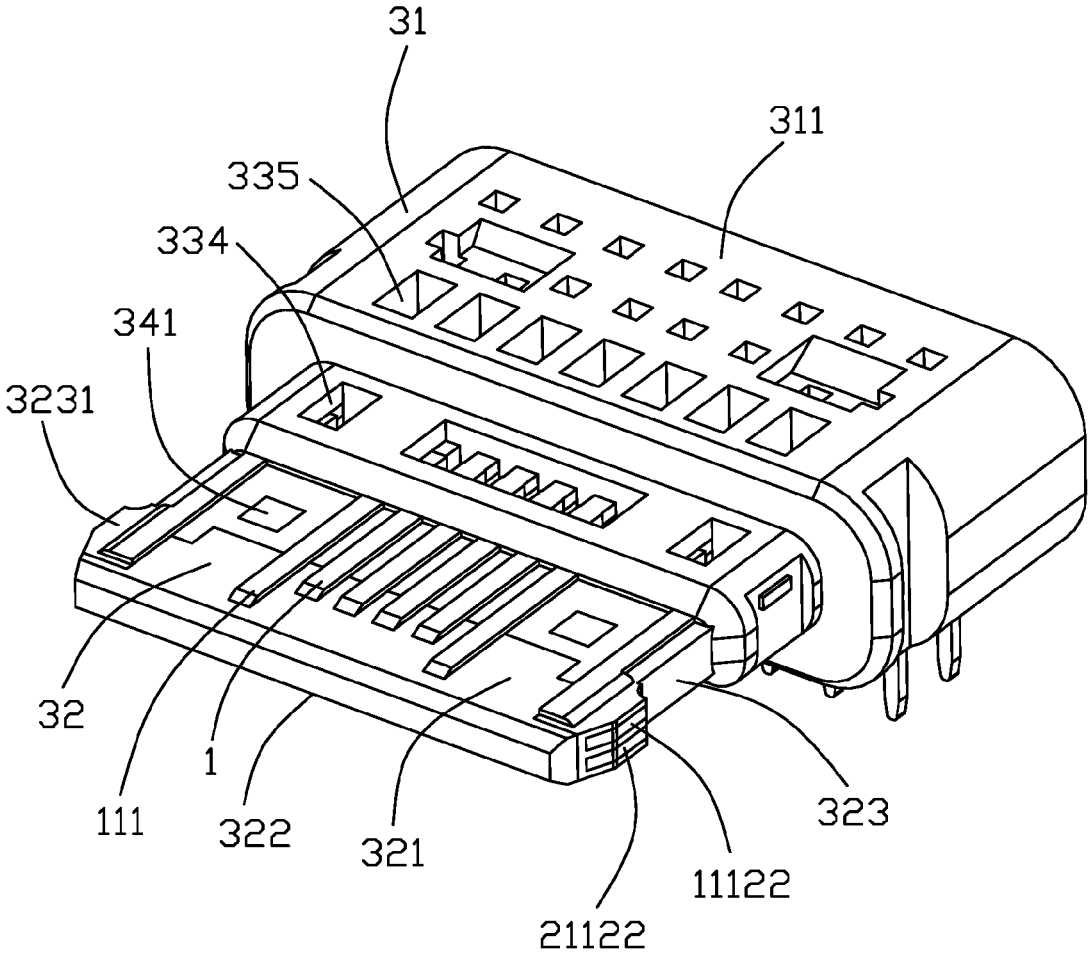
FIG. 3 is a front perspective view of the electrical connector without the metallic shell shown in FIG. 2.
Figure 4:
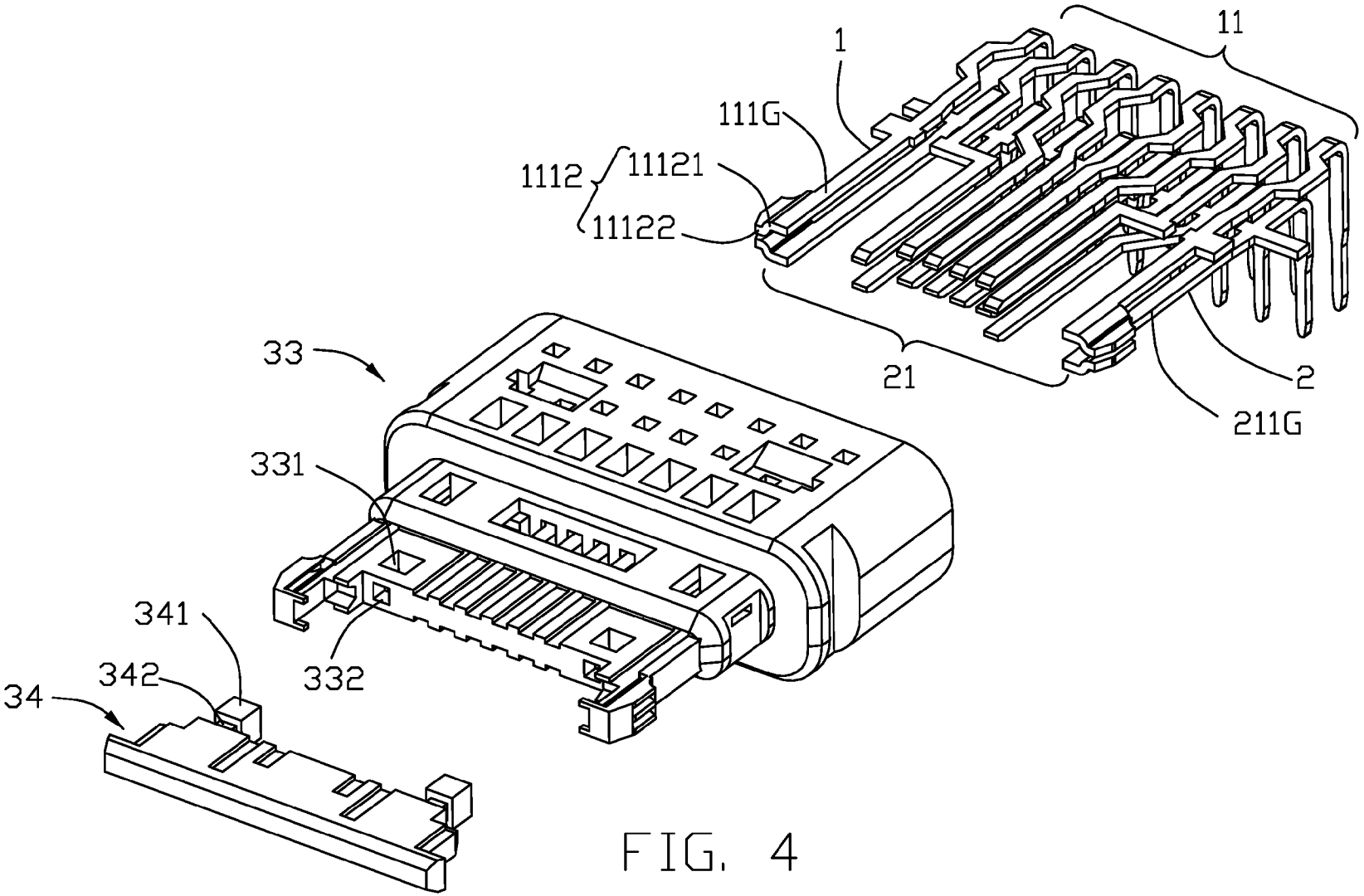
FIG. 4 is a top exploded perspective view of the electrical connector shown in FIG. 3.
Figure 5:
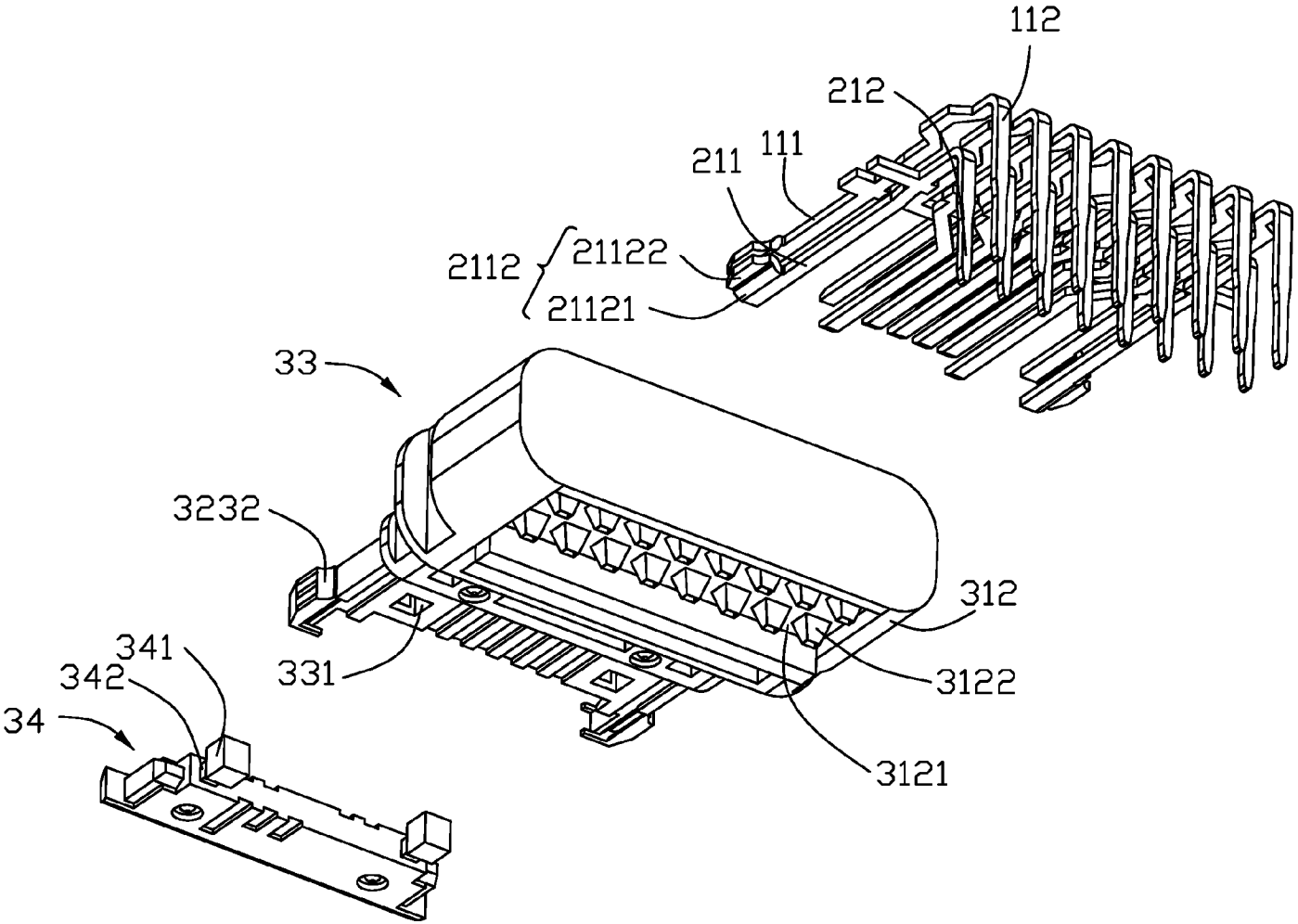
FIG. 5 is a rear exploded perspective view of the electrical connector shown in FIG. 4.
Figure 7:
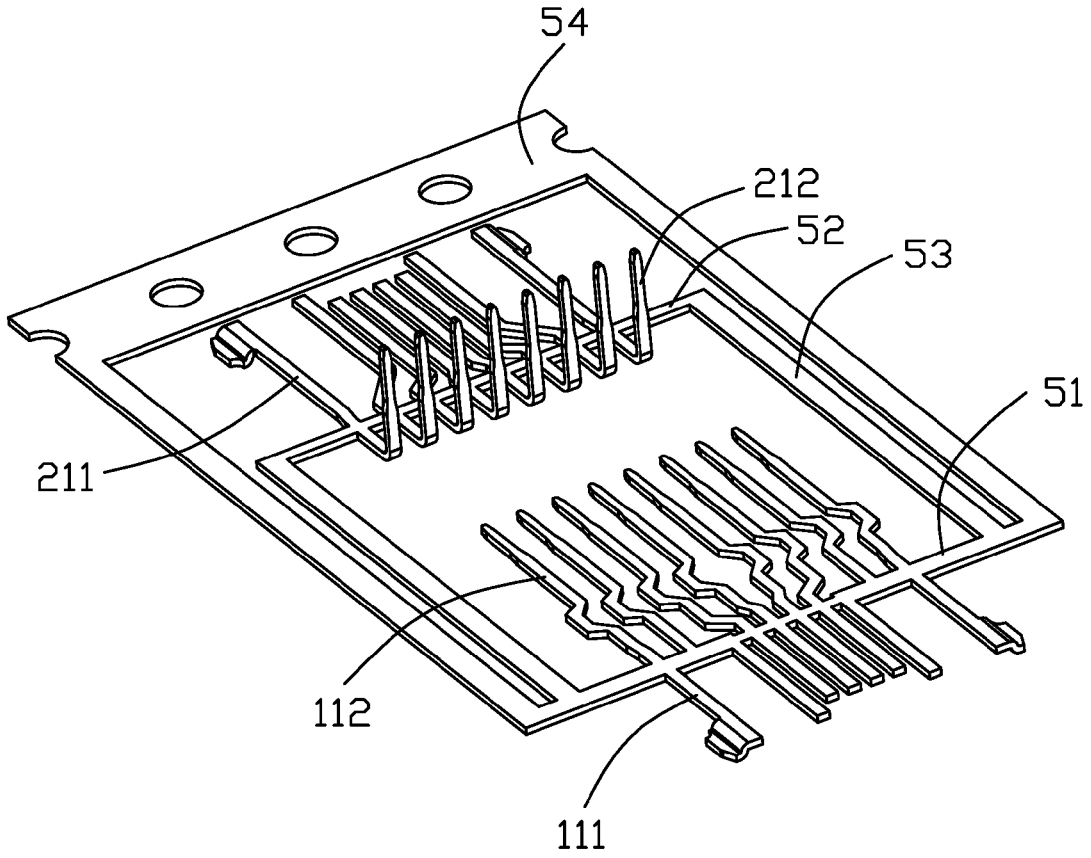
FIG. 7 is a top perspective view of the second tail portion bending shown in FIG. 6.
Figure 8:
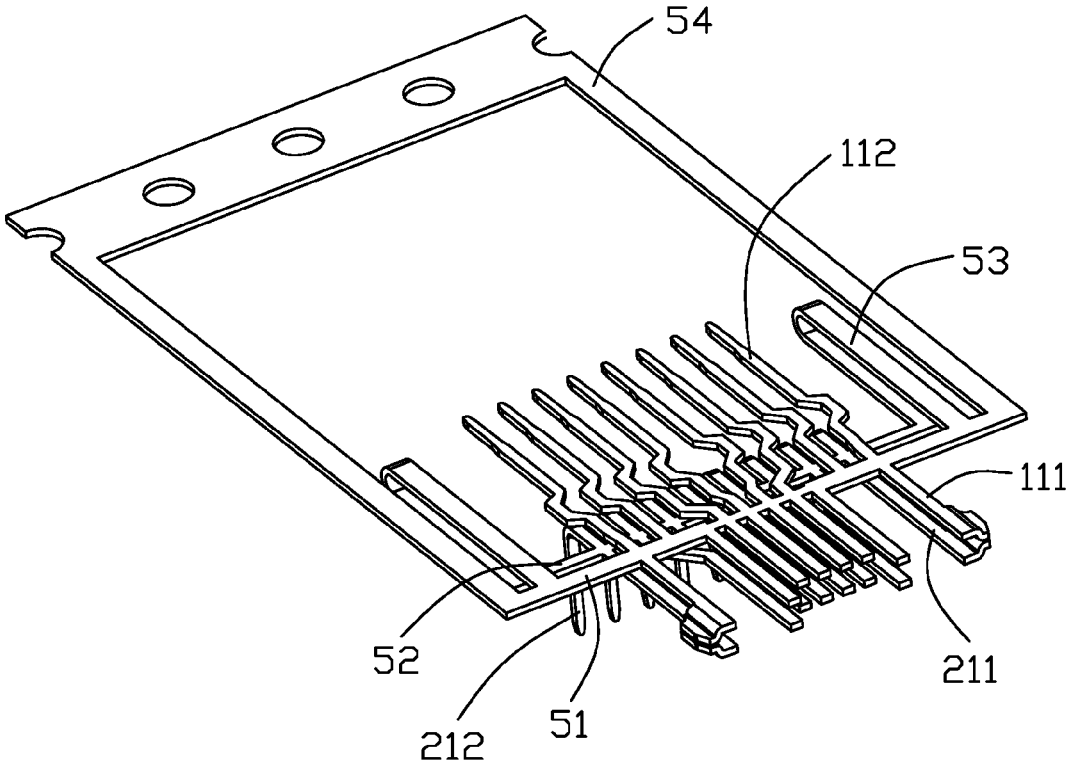
FIG. 8 is a top perspective view of the second terminal assembly bending shown in FIG. 7.
Figure 9:
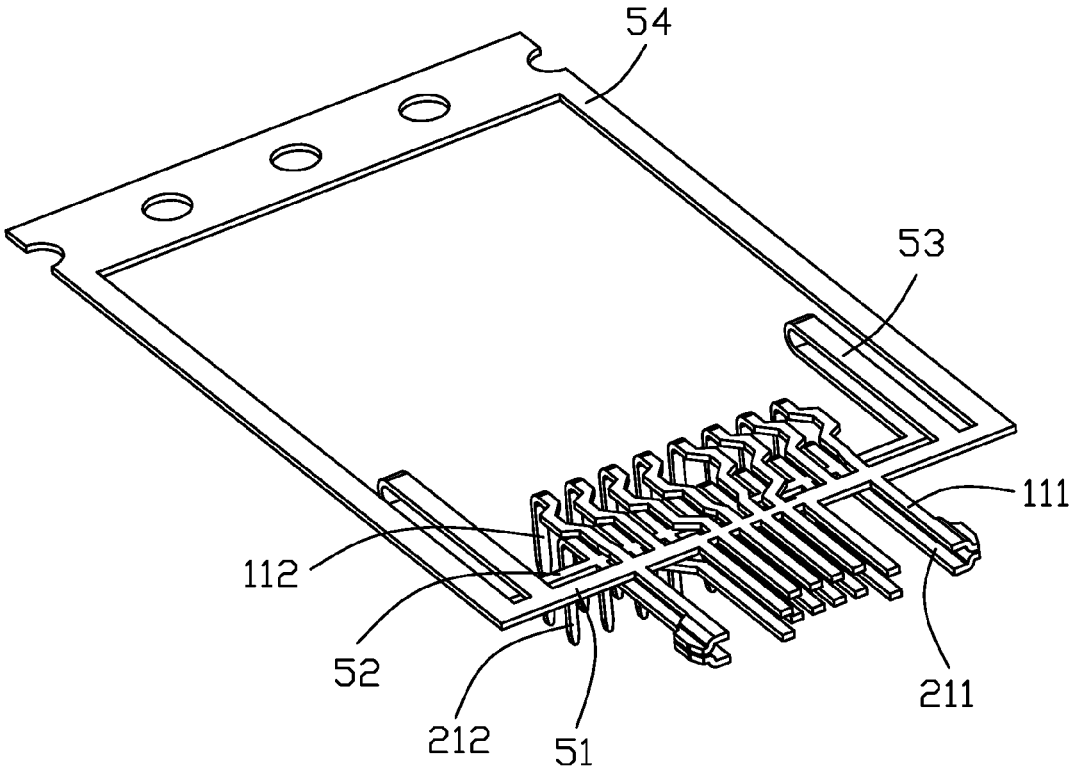
FIG. 9 is a top perspective view of the first tail portion bending shown in FIG. 8.
Figure 10:
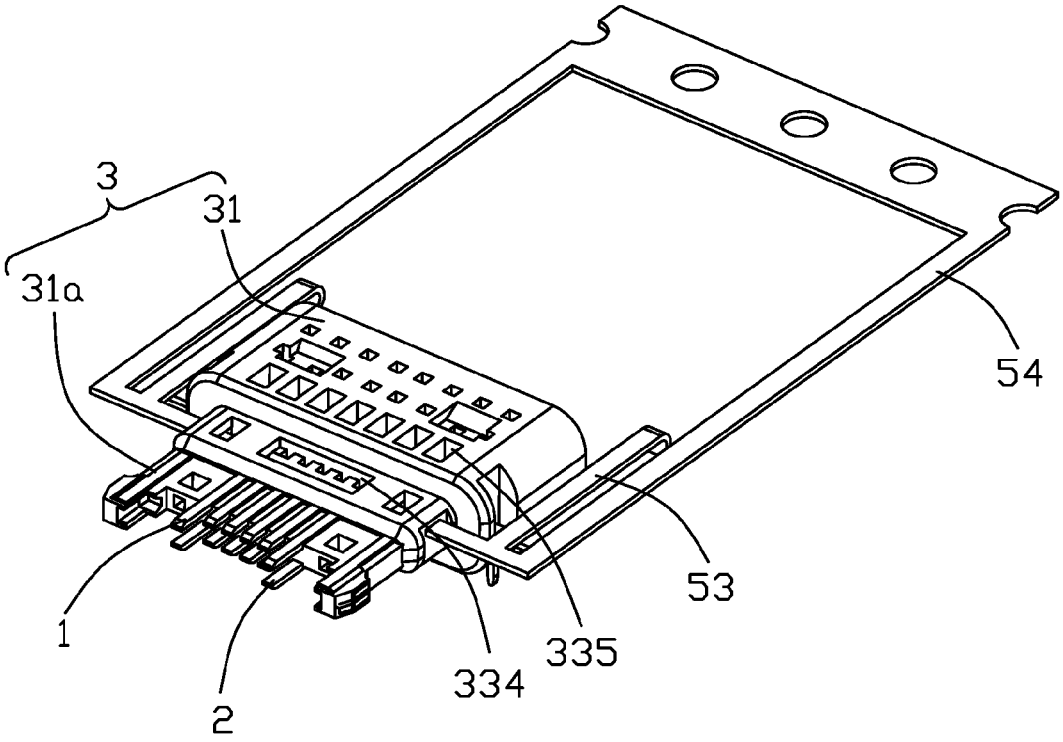
FIG. 10 is a top perspective view of the first insulating body being injection-molded on the first terminal assembly and the second terminal assembly.
Figure 11:
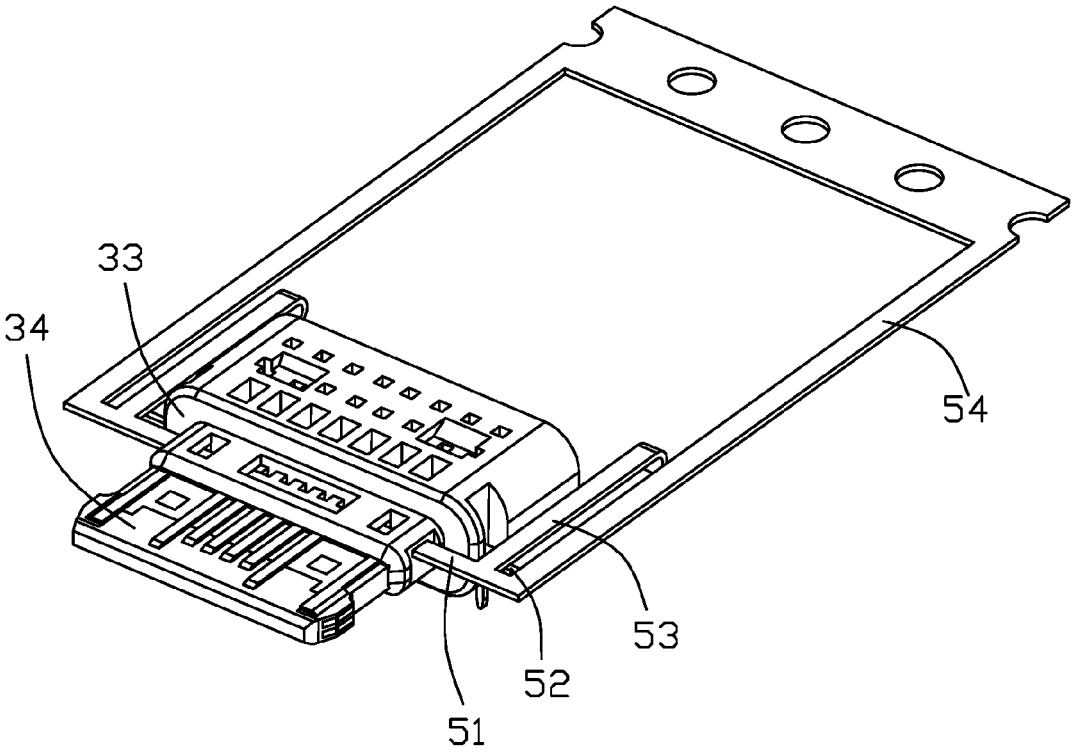
FIG. 11 is a top perspective view of the second insulating body formed by re-injection molding in the structure shown in FIG. 10.

Referring to FIGS. 6-9, the electrical connector 100 of a semi-finished product in the manufacturing process comprises a first terminal assembly 1, a second terminal assembly 2 respectively comprising a plurality of first conductive terminals 11 and second conductive terminals 21 and an insulative housing 3 being formed on the first terminal assembly 1 and the second terminal assembly 2 by the method of injection molding. The plurality of first conductive terminals 11 connect with one another by a first contact carrier 51. The plurality of second conductive terminals 21 connect with one another by a second contact carrier 52. A third contact carrier 53 is integrally connected between the first contact carrier 51 and the second contact carrier 52. One of the first contact carrier 51, second contact carrier 52 and third contact carrier 53 is connected with a fourth contact carrier 54. The fourth contact carrier 54 comprises a plurality of locating holes 541. The third contact carrier 53 and the fourth contact carrier 54 are at located outside of the insulating housing 3. Specifically, before injecting molding the insulating housing 3, the first terminal assembly 1 and the second terminal assembly 2 are connected through the first contact carrier 51, the second contact carrier 52, the third contact carrier 53 and the fourth contact carrier 54 to a flat plane. When the insulating housing 3 is injection-molded, the third contact carrier 53 is bent at a 180 degree such that the first terminal assembly 1 and the second terminal assembly 2 are arranged in a parallel and up-and-down manner. The fourth contact carrier 54 is not bent. Referring to FIGS. 10-11, After injection molding of the insulating main housing 3, the third contact carrier 53 and the fourth contact carrier 54 are located at outside of the insulating housing 3. The first contact carrier 51 extending of the insulative housing 3 from the mating tongue 32, the second contact carrier 52 extending of the insulative housing 3 from the base member 31. And then cutting the first contact carrier 51, second contact carrier 52, third contact carrier 53 and fourth contact carrier 54 to obtain the form shown in FIG. 3. Referring to FIG. 9 and FIG. 3, the first contact carrier 51 and the second contact carrier 52 are staggered in the mating direction of electrical connector 100. The insulative housing 3 includes a first cutting groove 334 corresponding to the first contact carrier 51 and a second cutting groove 335 corresponding to the second contact carrier 52. The first contact carrier 51 and second contact carrier 52 can be cut independently of each other respectively through the first cutting groove 334 and second cutting groove 335 to avoid overlapping cutting and damage the conductive terminals.

Referring to FIGS. 6-11, the method of manufacturing the electrical connector 100 will be described.

Figure 6:
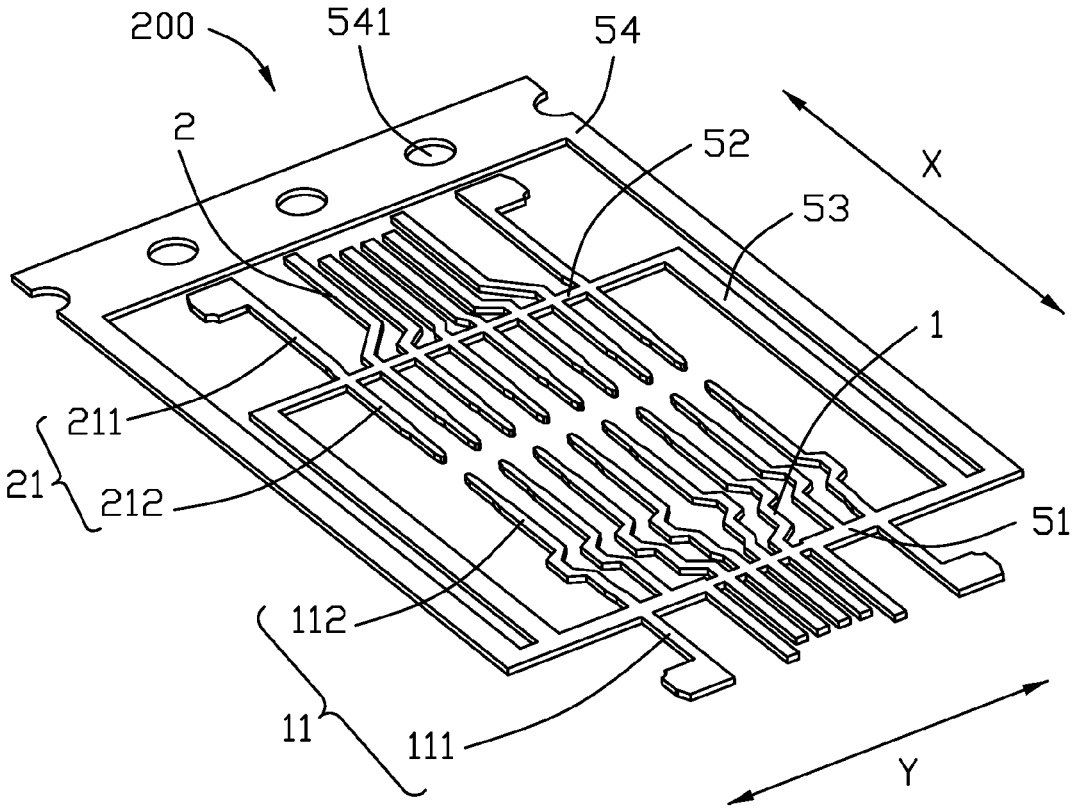
FIG. 6 is a top perspective view of the metal material stamping out the conductive terminals.

Referring to FIG. 6, (a) Providing a metal material 200 of flat sheet shape. The metal material is defined a first direction X (the mating direction) and a second direction Y orthogonal to each other. The metal material 200 is blanked to form a first terminal assembly 1 and a second terminal assembly 2. The first terminal assembly 1 and the second terminal assembly 2 are discrete with each other and in the same plane. The first terminal assembly 1 includes a plurality of first conductive terminals 11 arranged in the second direction Y. The first conductive terminal 11 comprises a first contact portion 111 and a first tail portion 112. The plurality of first conductive terminals 11 are connected to each other in the second direction Y by a first contact carrier 51. The second terminal assembly 2 includes a plurality of second conductive terminals 21 arranged in the second direction Y. The second conductive terminal 21 comprises a second contact portion 211 and a second tail portion 212. The plurality of second conductive terminals 21 are connected to each other in the second direction Y by a second contact carrier 52. The first tail portion 112 and the second tail portion 212 are located between the first contact carrier 51 and the second contact carrier 52 and extending opposite to each other. Understandably, the first contact carrier 51 refers to a combination of a plurality of sectors each linked between the neighboring first conductive terminals 11, and the second contact carrier 52 is as well. The first contact portion 111 and the second contact portion 211 are located at outside of the first contact carrier 51 and the second contact carrier 52 and extending in a direction away from each other. A third contact carrier 52 is integrally connected between the first contact carrier 51 and the second contact carrier 52. One of the first contact carrier 51, second contact carrier 52 and third contact carrier 53 is connected with a fourth contact carrier 54. The fourth contact carrier 54 comprises a plurality of locating holes 541.

Referring to FIGS. 7-9, (b) Bending the third contact carrier 53 at 180 degrees such that the first terminal assembly 1 and the second terminal assembly 2 are arranged in a up-and-down manner. Referring to FIGS. 10-11, (c) Providing an insulating material injecting molding on the first terminal assembly 1 and the second terminal assembly 2 to form an insulating housing 3 defining a base member 31 and a mating tongue 32. The insulating housing 3 is provided with a first cutting groove 334 and a second cutting groove 335 corresponding to the first contact carrier 51 and the second contact carrier 52. After injection molding of the insulating main housing 3, the third contact carrier 53 and the fourth contact carrier 54 are located at outside of the insulating housing 3. (d) Cutting and dislodging the first contact carrier 51 and the second contact carrier 52 by the first cutting groove 334 and a second cutting groove 335. Then cutting and dislodging the third contact carrier 53 and the fourth contact carrier 54. Finally, providing a metal housing 4 enclosing the insulating housing 3.

In a particular embodiment, after forming the first terminal assembly 1 and second terminal assembly 2 shown in FIG. 6, the second tail portion 212 is bent firstly, which is shown in FIG. 7. And then performing the step (b). The first tail portion 112 is bent before performing the step (c). Referring to FIGS. 10-11. In a particular embodiment, the step (c) comprises two parts. The insulating housing 3 comprises a first insulating body 33 which injecting molding on the first terminal assembly 1 and the second terminal assembly 2 firstly and a second insulating body 34 having better wear resistance than the first insulating body 33 which injecting molding on the first terminal assembly 1 and the second terminal assembly 2 secondly. The second insulating body 34 covers the front end surface of the mating tongue 32. The first insulating body 33 includes the base portion 31 and a main body portion 31*a* of the mating tongue 32. The main body portion 31*a* and the second insulating body 34 form the mating tongue together 32. The second insulating body 34 can not only directly form the mating tongue 32, but also increase strength for the mating tongue 32.

The electrical connector 100 of a semi-finished product in the manufacturing process is shown in the FIGS. 10-11. The semi-finished product comprises a first terminal assembly 1 and a second terminal assembly 2 respectively comprising a plurality of first conductive terminals 11 and second conductive terminals 21 and an insulative housing 3 being formed on the first terminal assembly 1 and the second terminal assembly 2 by the method of injection molding. The first terminal assembly 1 and the second terminal assembly 2 are arranged in a parallel manner and are spaced apart from each other. The plurality of first conductive terminals 11 of the semi-finished product connect with each other by a first contact carrier 51. The plurality of second conductive terminals 21 of the semi-finished product connect with each other by a second contact carrier 52. A third contact carrier 53 is integrally connected between the first contact carrier 51 and the second contact carrier 52. One of the first contact carrier 51, second contact carrier 52 and third contact carrier 53 is connected with a fourth contact carrier 54. The fourth contact carrier 54 comprises a plurality of locating holes 541. The third contact carrier 53 and the fourth contact carrier 54 are located at outside of the insulating housing 3. In brief, compared with the traditional Type C connector using at least two discrete contact carriers derived from different sheet metal to form the first terminal assembly and the second terminal assembly for the two different insert-molding processes, the feature of the invention is to provide a single metal sheet with both first terminal assembly and second terminal assembly thereon for applying an insulative housing thereto via only one single/one shot insert-molding process for easing the process and saving the manufacturing cost.

In conclusion, the present invention simplifies the manufacturing process of the electrical connector 100 by manufacturing the first terminal assembly 1 and the second s terminal assembly 2 on the one piece of the metal material 200 and injecting molding the insulating housing 3. At the same time, it effectively saving the cost.

What is claimed is:

1. An electrical connector of a semi-finished product in a manufacturing process comprising:

a first terminal assembly comprising a plurality of first conductive terminals;

a second terminal assembly comprising a plurality of second conductive terminals; and an insulative housing formed on the first terminal assembly and the second terminal assembly by the method of injection molding;

wherein the first terminal assembly and the second terminal assembly are arranged in a parallel manner and are spaced apart from each other, the plurality of first conductive terminals connect with one another by a first contact carrier which extends transversely and is designated to be removed later, the plurality of second conductive terminals connect with one another by a second contact carrier which extends transversely and is designed to be removed later, a third contact carrier, which is designated to be bent and removed later, is integrally connected, either directly or indirectly, between the first contact carrier and the second contact carrier;

wherein one of the first contact carrier, second contact carrier and third contact carrier is connected, either directly or indirectly, with a fourth contact carrier which extends transversely and comprises a plurality of locating holes and designed to be remove later, the third contact carrier and the fourth contact carrier are located at outside of the insulating housing for easy removal.

2. The electrical connector as claimed in claim 1, wherein the third contact carrier is bent at a 180 degree such that the first terminal assembly and the second terminal assembly are arranged in a parallel manner, while the fourth contact carrier is not bent.

3. The electrical connector as claimed in claim 1, wherein the insulative housing defines a base member and a mating tongue extending forwardly from the base member in a mating direction, the first contact carrier extends outwardly of the insulative housing from the mating tongue, the second contact carrier extends outwardly of the insulative housing from the base member.

4. The electrical connector as claimed in claim 3, wherein each of the first conductive terminal comprises a first contact portion, each of the second conductive terminal comprises a second contact portion, the two of the outermost first contact portions of the first terminal assembly are first grounding contact portions, the two of the outermost second contact portions of the second terminal assembly are second grounding contact portions, the first and the second grounding contact portions have reinforcing pieces extending from respective outer side edges thereof, the reinforcing piece is first bent toward the middle of the mating tongue in a height direction and then bent outwardly in a transverse direction perpendicular to the height direction to form a locking side edge.

5. The electrical connector as claimed in claim 4, wherein two side edges of the mating tongue are respectively provided with a protruding portion, each protruding portion comprises a stopper portion located behind the mating tongue, the locking side edge is exposed to outside of the stopper portion.

6. The electrical connector as claimed in claim 3, wherein the mating tongue is provided with a first cutting groove corresponding to the first contact carrier, the base member is provided with a second cutting groove corresponding to the second contact carrier.

7. The electrical connector as claimed in claim 3, wherein the insulating housing comprises a first insulating body which injecting molding on the first terminal assembly and the second terminal assembly firstly and a second insulating body having better wear resistance than the first insulating body which injecting molding on the first terminal assembly and the second terminal assembly secondly.

8. The electrical connector as claimed in claim 7, the second insulating body is at least coated on the front end surface of the mating tongue.

9. The electrical connector as claimed in claim 8, wherein the first insulating body defined a first fixing hole passing through the upper surface and the lower surface of the first insulating body, the front surface of the first insulating body penetrates through a second fixing hole connected with the first fixing hole.

10. The electrical connector as claimed in claim 9, wherein the insulating material forming the second insulating body enters the first hole and second fixing hole respectively to form the first fixing block and the second fixing block connected with the first fixing block.

11. A method of manufacturing an electrical connector including steps of:

providing a metallic material in a form of sheet to define a first direction and a second direction orthogonal to each other, the metal material being blanked to form a first terminal assembly and a second terminal assembly, the first terminal assembly and the second terminal assembly being discrete from each other and in a same plane along the first direction, the first terminal assembly including a plurality of first conductive terminals arranged in the second direction, the first conductive terminal comprising a first contact portion and a first tail portion, the plurality of first conductive terminals being connected to each other in the second direction by a transversely extending first contact carrier, the second terminal assembly including a plurality of second conductive terminals arranged in the second direction, the second conductive terminal comprising a second contact portion and a second tail portion, the plurality of second conductive terminals being connected to each other in the second direction by a transversely extending second contact carrier, a third contact carrier is integrally connected, either directly or indirectly, between the first contact carrier and the second contact carrier, one of the first contact carrier, second contact carrier and third contact carrier being connected, either directly or indirectly, with a single fourth contact carrier which comprises a plurality of locating holes for holding the metal material during a later insert-molding process;

bending the third carrier to have the first terminal assembly and the second terminal assembly positioned with each other in a third direction perpendicular to both said first direction and said second direction; and applying an insulative housing upon both said first terminal assembly and said second terminal assembly via a single insert-molding process.

12. The method as claimed in claim 11, further including a step of removing the first contact carrier, the second contact carrier, the third contact carrier and the further contact carrier, wherein said housing forms a plurality of cutting grooves corresponding to the first contact carrier and said second contact carrier for implementing removal thereof.

13. The method as claimed in claim 11, wherein the first tail portion and the second tail portion are located between the first contact carrier and the second contact carrier and extending opposite to each other in the first direction, while the first contact portion and the second contact portion are located outside of the first contact carrier and the second contact carrier.

14. The method as claimed in claim 11, wherein both said third contact carrier and said fourth contact carrier are located outside of the housing for easy removal.

15. The method as claimed in claim 11, wherein the second tail portion is bent before bending the third contact carrier, and the first tail portion is bent before applying the housing upon both said first terminal assembly and said second terminal assembly.

16. An electrical connector derived from a semi-finished product, comprising:

a first terminal assembly and a second terminal assembly arranged with and spaced from each other in a vertical direction and commonly integrally formed with an insulative housing via a one-shot insert-molding process, said first terminal assembly including a plurality of first conductive terminals transversely spaced from each other while originally linked with one another via a transversely extending first contact carrier which originally exists in said semi-finished product while being successively removed from the electrical connector after the insert-molding process;

said second terminal assembly including a plurality of second conductive terminals transversely spaced from one another while originally linked with one another via a transversely extending second contact carrier which originally exists in said semi-finished product while being successively removed from the electrical connector after the insert-molding process; wherein said first contact carrier and said second contact carrier are configured to be originally linked indirectly to each other by a longitudinal extending third contact carrier which originally exists in the semi-finished product while being removed after the insert-molding process.

17. The electrical connector as claimed in claim 16, wherein a joined position between the first contact carrier and said third contact carrier is located around a first position along a side edge of the housing, and another joined position between the second contact carrier and said third contact carrier is located a second position in along said side edge of the housing and spaced from the first position in a front-to-back direction perpendicular to said vertical direction.

18. The electrical connector as claimed in claim 16, wherein said first conductive terminals include two first grounding terminals located on two opposite outermost positions in a transverse direction perpendicular to said vertical direction, and said second conductive terminals include two second grounding terminals located on two opposite outermost positions in said transverse direction, and the first grounding terminal having a transversely and outwardly extending reinforcing piece to be aligned with another transversely and outwardly extending reinforcing piece of the corresponding second grounding terminal in the vertical direction and both embedded within a transversely and outwardly extending protruding portion of the housing for latching with a plug connector.

19. The electrical connector as claimed in claim 18, wherein the reinforcing piece of the first grounding terminal and the corresponding reinforcing piece of the second grounding terminal contact with each other in the vertical direction.

20. The electrical connector as claimed in claim 16, wherein the removed third contact carrier defines a U-shaped configuration which is backwardly bent from a strip configuration which originally extends along a front-to-back direction perpendicular to said vertical direction.

* * * * *